US008919448B2

(12) United States Patent
Dziekonski

(10) Patent No.: US 8,919,448 B2
(45) Date of Patent: Dec. 30, 2014

(54) MODULAR STRESS JOINT AND METHODS FOR COMPENSATING FOR FORCES APPLIED TO A SUBSEA RISER

(76) Inventor: Mitchell Z. Dziekonski, Sugar Land, TX (US)

( * ) Notice: Subject to any disclaimer, the term of this patent is extended or adjusted under 35 U.S.C. 154(b) by 151 days.

(21) Appl. No.: 13/506,352

(22) Filed: Apr. 13, 2012

(65) Prior Publication Data

US 2013/0269946 A1 Oct. 17, 2013

(51) Int. Cl.
*E21B 33/038* (2006.01)
*E21B 17/08* (2006.01)

(52) U.S. Cl.
CPC ..... *E21B 33/038* (2013.01); *E21B 17/085* (2013.01)
USPC ..... 166/345; 166/367; 405/169; 405/224.2

(58) Field of Classification Search
CPC ..... E21B 17/01; E21B 17/085; E21B 33/038
USPC ..... 166/345, 350, 352, 367, 242.1; 138/155, 177, 178; 285/417, 422, 425, 285/923; 405/169, 170, 224.2
See application file for complete search history.

(56) References Cited

U.S. PATENT DOCUMENTS 3,605,413 A * 9/1971 Morgan ..... 405/211
3,768,842 A 10/1973 Ahlstone
4,188,156 A * 2/1980 Fisher et al. ..... 405/224.3
4,194,568 A * 3/1980 Buresi et al. ..... 166/340
4,212,561 A 7/1980 Wipkink
4,256,417 A * 3/1981 Bohannon ..... 405/224.2
4,424,988 A * 1/1984 Cowx ..... 285/2
4,511,287 A * 4/1985 Horton ..... 405/204
4,537,429 A * 8/1985 Landriault ..... 285/334
4,629,224 A * 12/1986 Landriault ..... 285/334
4,634,314 A 1/1987 Pierce
4,708,525 A 11/1987 Beynet et al.
4,768,984 A * 9/1988 de Oliveira et al. ..... 441/21
4,854,781 A * 8/1989 Sparks et al. ..... 405/224.4
5,415,047 A 5/1995 Maciejewski et al.
5,447,390 A * 9/1995 Sparks et al. ..... 405/195.1
5,657,823 A * 8/1997 Kogure et al. ..... 166/340
5,873,677 A * 2/1999 Davies et al. ..... 405/195.1
6,397,951 B1 6/2002 Roberts
6,422,316 B1 * 7/2002 Schutz et al. ..... 166/367
6,467,545 B1 * 10/2002 Venkataraman et al. ..... 166/367
6,659,690 B1 * 12/2003 Abadi ..... 405/224.2
6,860,525 B2 * 3/2005 Parks ..... 285/391
6,893,057 B2 * 5/2005 Evans ..... 285/334
8,430,170 B2 * 4/2013 Pionetti ..... 166/350
2012/0273213 A1 * 11/2012 Blalock et al. ..... 166/341

* cited by examiner

*Primary Examiner* — Matthew Buck

(57) ABSTRACT

Modular stress joints usable to compensate for forces applied to a subsea riser or other structure include a base member and one or more additional members. Members having desired lengths can be selected such that the sum of the length of the base member and additional members defines a desired total length. Members having desired wall thicknesses can be selected such that a combination of the wall thicknesses of the base member and each additional member defines an overall wall thickness or stiffness. The total length, overall wall thickness, or both correspond to expected forces applied to the subsea riser or structure, such that the stress joint is adapted to compensate for the forces and prevent damage. The number or length of members used and their thickness or other characteristics can be varied to provide multiple lengths and stiffnesses, such that the stress joint is modular and reconfigurable.

20 Claims, 7 Drawing Sheets

MODULAR STRESS JOINT AND METHODS FOR COMPENSATING FOR FORCES APPLIED TO A SUBSEA RISER

FIELD

Embodiments usable within the scope of the present disclosure relate, generally, to structures usable to resist and/or compensate for forces applied to an object, and more specifically, to a stress joint and methods for compensating for forces applied to a subsea riser and/or a similar marine object.

BACKGROUND

Conventionally, accessing a subsea well (e.g., for production therefrom and/or performing various operations on or within the wellbore) requires use of a conduit, known as a riser, which extends from the wellhead of the subsea well to or near the surface of a body of water. While the specific structure and features of risers can vary, in general, each riser will include a number of steel tubular segments, threaded or otherwise connected to one another, to span the distance between the subsea wellhead and the surface. Due to the significant length of a riser, it is expected that various forces, such as heave, wave motion, currents, and/or other similar forces imparted by the body of water, impacts with subsea objects, and/or the weight and flexibility/sway of the riser itself, will cause the riser to move and/or bend to a certain extent. Additionally, wind forces applied to a surface object, such as a semisubmersible or vessel engaged to the upper end of the riser, and/or movement of the surface object, can also impart a force to the riser.

Due to the limited flexibility of the steel segments of a riser, special measures must be taken to compensate for forces that could otherwise flex or move a riser beyond its structural integrity, causing the riser to become damaged. For example, some types of motion (e.g., heave forces) experienced by risers and/or surface objects engaged thereto can be compensated for using various cylinder-based compensation systems that cause the riser and/or other objects to remain effectively stationary relative to other objects and/or to the Earth's surface. However, in nearly all cases, at least some lateral motion and/or bending will be experienced by all portions of the riser, to some extent, e.g., a lateral movement of the upper end of the riser will cause the lowest point of the riser to bend slightly to account for this movement, the difference between the relative movements of the upper and lower ends depending on the total length of the riser.

To allow for this expected bending motion most riser systems include a stress joint secured at the base of the riser. Conventional stress joints are unique structures, each specifically and precisely engineered to account for the forces and movements expected to be experienced by a riser, based on the riser length, thickness, materials, depth, and various meteorological and oceanographic (metocean) environments. Thus, a custom-designed stress joint is normally designed and constructed for each specific subsea well and riser condition. A typical stress joint is a tapered structure, wider at its base than its upper end, the taper angles and radii of curvature along the body of the joint being precisely designed to allow a certain amount of bending commensurate with the expected motion of the upper end of the riser. While a stress joint is normally secured, to a subsea wellhead at its lower end, and to a riser at its upper end, substantially similar structures are usable in other positions and/or applications. For example, a keel joint can be secured at the upper end of a riser, the keel joint having a structure substantially similar or identical to that of a stress joint, but inverted, e.g., a typical keel joint has a tapered body with a wide end oriented to face upward, while a narrower end, facing downward, engages the upper end of the riser. Stress joints are also sometimes used at curved points along a riser (e.g., a catenary joint.)

Most stress joints are formed from steel, and must be a single-piece, unitary structure due to the fact that a multiple-part structure would be subject to weaknesses and additional forces at the points of engagement between parts. As a result, stress joints are an extremely expensive part of a riser system, both due to the unique design engineering involved, the massive, precision construction thereof, as well as the difficulties and costs inherent in qualifying, testing, and transporting the single-piece, heavy structure to a subsea location. Extensive time and expense is required when custom designing and manufacturing each stress joint for each specific condition and/or configuration. Under some circumstances, the length of a riser and/or the expected movement thereof or forces applied thereto render use of a unitary steel stress joint impossible due to the fact that a stress joint able to account for the expected forces and motion would be prohibitively large, and nearly impossible to construct or transport. In such cases, other, more flexible materials, such as titanium, have been used to form stress joints. Existing titanium stress joints must still be precisely engineered based on the specific features of each unique well and riser, and still include tapered, one-piece bodies, and as such, remain costly and cumbersome items, due not only to construction and transport difficulties and costs, but also due to the increased cost of the materials when compared to steel. Additionally, titanium stress joints include welded flanges, which create points of stress, weakness, and/or unfavorable distribution of forces that must be accounted for during the design and engineering process. Furthermore, much like their steel counterparts, titanium stress joints also require extensive time and expense to design and manufacture.

A need exists for stress joints that are adjustable (e.g., modular), thus able to be used with a variety of subsea well and riser configurations, and able to be recovered after use and reused with other wells and risers.

A need also exists for stress joints that incorporate combinations of parts and materials that effectively compensate for the forces applied to a riser, while remaining low in cost, reliable, and convenient to construct and transport when compared to large, single-piece structures.

A further need exists for stress joints that can be available for use rapidly, such as through immediate transport and installation of pre-manufactured and stored parts usable with a large variety of subsea well and riser configurations.

Embodiments usable within the scope of the present disclosure meet these needs.

SUMMARY

Embodiments usable within the scope of the present disclosure relate to modular stress joints and methods for compensating for forces applied to a subsea riser, and/or similar marine objects. While exemplary embodiments described herein relate to stress joints that are secured to a subsea wellhead and a subsea riser, it should be understood that other applications of the present stress joints and methods can also be used without departing from the scope of the present disclosure. For example, the stress joints described herein can be inverted and used as a keel joint at the upper end of a riser. Further, due to the modular nature of the stress joints disclosed herein, the present stress joints can be used along curved portions of a riser, or any other subsea conduit, in place of a conventional catenary joint, along horizontal portions of a riser or conduit (e.g., at a touchdown point proximate to a subsea floor), on one or both sides of curved portion in a conduit (e.g., a portion of a conduit supported by a buoy), and in other similar applications.

Stress joints usable within the scope of the present disclosure can include a base member, engaged with one or more additional members, each member having a respective length, wall thickness, and/or other material characteristics, such that the assembly of structural members to form the stress joint provides the stress joint with a desired overall length and/or stiffness. In an embodiment, the base member can have a tapered (e.g., sloped and/or curved) body, with a first end with a first width and a second end with a second, lesser width. Typically the first (e.g., wider) end would be oriented proximate to and/or engaged with a subsea wellhead, while the second (e.g., narrower) end would be oriented upward (e.g., facing the surface). Further, as described above, the present stress joint could be used in the manner of a keel joint, having a first (e.g., wider) end of the base member oriented upward for engagement with a vessel (e.g., a rig, semisubmersible, ship, etc.), while a second (e.g., narrower) end thereof is oriented downward for engagement with a riser and/or other subsea conduit. In other embodiments, the base member could be a generally straight, tubular member, lacking a tapered body, and/or could have other shapes, as desired, to provide the base member with a desired degree of flexibility at certain points, and/or a desired distribution of forces therealong.

At least one additional member (e.g., a tubular member), can be secured to an end of the base member. The base member and each additional member can have a respective length and a respective wall thickness. When the modular stress joint is assembled, the sum of the length of the base member each additional member connected in this fashion defines a total length, which can be selected to correspond to expected forces acting on the riser (e.g., relating to the length, depth, dimensions, and/or materials of the riser and/or various subsea conditions). For example, a selection can be made from tubular members of varying lengths, to provide the overall stress joint with a total length calculated to effectively compensate for expected forces. Similarly, the wall thicknesses of each member of the stress joint can be selected to provide the stress joint with a desired stiffness at desired points along the stress joint, thus enabling each member to distribute stress across the joint in a desirable manner. For example, one or more of the members could be provided with tapered shapes, or varying wall thicknesses, to provide the stress joint with a varying stiffness that is graduated along the length thereof. As such, due to the modular nature of the stress joint, the total length of the stress joint can be adjusted by selecting a number and/or length of members that provide the desired total length, while the wall thickness of the stress joint remains generally constant. Alternatively, the wall thickness of the stress joint could be adjusted (e.g., through selection of members having desired thicknesses) to correspond to a desired total length. In other embodiments, both the length and wall thickness could be selected, as needed, through the assembly of desired structural members, such that the overall stress joint or desired portions thereof are provided with desired characteristics and a desired distribution of forces therealong, such that the stress joint can be immediately useable with any subsea well, riser, or other structure or conduit simply by varying the number and/or characteristics of members, and thus, the overall length and/or stiffness of the stress joint. The resulting joint can thereby permit an amount of bending and/or flexing sufficient to compensate for the expected forces and/or movement of the riser, e.g., by favorably distributing forces along the length of the joint.

In an embodiment, the base member can have a lower portion (e.g., a circular and/or cylindrical section), having a width greater than that of other portions of the base member, with a curvature between the lower portion and the remainder of the base member adapted to compensate for expected forces and prevent damage to the riser. For example, the radius of the curvature between the lower portion and the remainder of the base member can permit a certain quantity of movement and/or bending thereof, while distributing the resulting forces favorably along the curvature to prevent damage and/or failure of the stress joint. Similarly, one or more additional curvatures can be disposed along the body of the base member, each adapted to compensate for expected forces and prevent damage to the riser. In other embodiments, the base member could include a generally cylindrical shape, e.g., having varying wall thicknesses along the length thereof. Embodiments usable, within the scope of the present disclosure can also include a swivel flange or similar movable and/or rotatable member secured to the base member (e.g., above, over, and/or otherwise engaged to the lower portion thereof).

While any manner of engagement between the base member and/or any additional members can be used without departing from the scope of the present disclosure, in a preferred embodiment, the base member and additional members can include exterior threads formed on ends thereof, which are engageable with (e.g., complementary to) interior threads of a connector engageable between adjacent members. Connectors can include members having similar or differing diameters, and can include other means of connection, such as clamping. Use of connectors in this manner eliminates the need for welding between members, thereby preventing the creation of stress point and/or weaknesses in the joint. Further, use of members that do not require flanged ends and/or welding enables portions of the embodied stress joint to be manufactured from standard stock tube, rather than requiring the members to be custom forged, thereby reducing the required cost and time for manufacture and installation.

Additionally, while the base member, the additional members, and the connectors can be formed from any suitable material without departing from the scope of the present disclosure, in an embodiment, the base member and one or more additional members can be formed from a material having a lower modulus of elasticity than that of the connectors. For example, the base member and any additional members could be formed from titanium, while the connectors are formed from steel. Use of a combination of low and high modulus materials, such as base and tubular components having a low modulus of elasticity and connectors having a higher modulus of elasticity, can provide a favorable distribution of stresses along the stress joint without creating weaknesses at the points of connection between members. For example, during typical use, the points of connection between members will bear the greatest portion of the stress applied to the joint, and as such, use of connectors formed from a generally stiff material can facilitate the ability of the stress joint to withstand such forces. This low/high combination of moduli also provides a mechanism for more reliable sealing between tubular components and connector components when subjected to internal well pressures. While in a preferred embodiment, connectors formed from steel or a similar high modulus material and structural members formed from titanium or a similar low modulus material can be used, it should be understood that in other embodiments, other materials having desirable characteristics could be used to form any part of the stress joint, independent of the relative moduli thereof. For example, in an embodiment, each member of the stress joint, including the connectors, could be formed from steel, stainless steel, nickel, or any combinations or alloys thereof (e.g., a steel-nickel alloy).

Embodiments usable within the scope of the present disclosure thereby provide modular stress joints and related methods usable with many well and/or riser configurations, and in other applications (e.g., as a keel joint or a catenary joint), through adjustment of the length thereof (e.g., by selection of a desired number of modular members) and/or adjustment of the stiffness thereof (e.g., by selection of modular members having desired wall thicknesses and/or other dimensional and/or material characteristics), thus facilitating rapid customization of the configuration, and ease of transport and assembly, while also enabling almost universal applicability to most wells or other objects, risers or other conduits, or subsea environments/conditions. Additionally, assembly of a stress joint from variable, configurable components, rather than custom-engineered parts, enables components thereof to be pre-manufactured and stored, such that when installation of a stress joint is necessary, existing parts can be selected from storage based on the desired configuration, transported to an operational site, and installed, thus eliminating the lead time and opportunity cost inherent in custom manufacturing a conventional stress joint. Embodiments usable within the scope of the present disclosure further provide modular stress joints and related methods that can include a combination of high and low modulus materials, specifically, members having a threaded pin with a lower modulus of elasticity, connected into couplings having a higher modulus.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 1A:
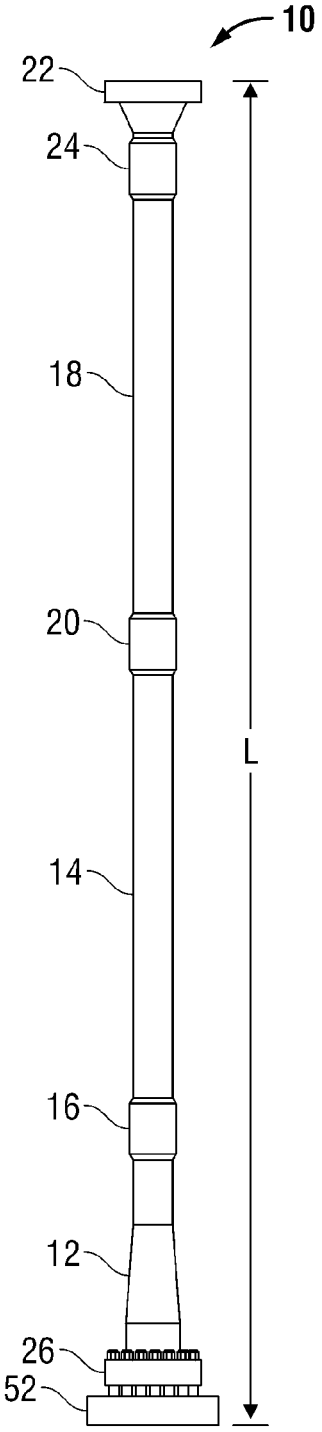
FIG. 1A depicts a diagrammatic side view of an embodiment of a modular stress joint usable within the scope of the present disclosure.

Referring now to FIG. 1A, a diagrammatic side view of an embodiment of a modular stress joint (10) usable within the scope of the present disclosure is shown. Specifically, the depicted embodiment is shown having a base member (12), engaged with a first tubular member (14), via a first coupling connector (16) (e.g., a threaded collar), and a second tubular member (18), engaged with the first tubular member (14), via a second coupling connector (20). A top flange (22) (e.g., a connector for engagement to a riser) is shown engaged with the second tubular member (18) via a third coupling connector (24). However, in an alternative embodiment a top flange with an integrated female threaded end for connecting directly to the second tubular member, without use of an additional coupling connector, could be used. A swivel flange (26) and a base flange (52) are shown engaged with the base member (12) and with one another, e.g., for securing the stress joint (10) to a wellhead structure and/or other surface below. It should be understood that the depicted configuration (e.g., including a base member (12) and two tubular members (14, 18)), is merely exemplary, and in other configurations, the top flange (12) could be connected directly to the base member (12) or the first tubular member (14) for engagement with a riser, depending on the desired overall length (L) of the stress joint (10). Similarly, while FIG. 1A depicts two tubular members (14, 16) having generally equal lengths, in other embodiments, either tubular member (14, 16) could have a shorter or longer length to provide the stress joint (10) with a desired overall length (L) corresponding to forces imparted to and/or movement of the associated riser and/or other subsea conduit.

The depicted stress joint (10) is usable to compensate for forces applied to and/or movement of a riser connected thereto (e.g. via top flange (22)) by allowing a predetermined amount of bending determined by the taper and/or curvature of the base member (12) and/or either of the tubular members (14, 18), the total length (L) of the stress joint, which is adjustable (e.g., modular) by selecting a given number of tubular members of similar or different lengths to be engaged to the base member (12), and the stiffness of the stress joint (10) along the length thereof, which can be adjusted by selecting base and/or tubular members having desired material characteristics and/or wall thicknesses. As such, the material of the tubular members (14, 18), base member (12), and connectors (16, 20, 24) can be preselected to permit a certain amount of bending thereof and a favorable distribution of forces along the length (L) of the stress joint (10). For example, the depicted embodiment could include a base member (12) and two tubular members (14, 18), having an overall length of approximately 30 feet, in which the base member (12) and tubular members (14, 18) are formed from a material having a generally low modulus of elasticity, such as titanium, while the connectors (16, 20, 24) are formed from steel or another material having a generally higher modulus of elasticity usable to accommodate for the fact that greatest amount of stresses on the stress joint (10) will be experienced at the connectors (16, 20, 24). Other embodiments can include a stress joint (10) in which each member (12, 14, 18) and connector (16, 20, 24) is formed from the same material, such as steel, stainless steel, nickel, or any combinations or alloys thereof (e.g., a steel-nickel alloy). It should be understood that the materials used to form any members (12, 14, 18) and/or connectors (16, 20, 24) of the stress joint (10) can be varied, as needed, to provide desired structural characteristics thereto, without departing from the scope of the present disclosure.

It should be understood that while FIG. 1A depicts an embodiment of a stress joint (10) having two generally cylindrical tubular members (14, 18) of generally equal length and diameter, any number of tubular members, having any length, diameter, shape, and/or material could be used without departing from the scope of the present disclosure, to provide the stress joint (10) with a desired length (L) determined to effectively compensate for expected forces encountered by a riser attached thereto. Similarly, while FIG. 1A depicts a base member (12) having a tapered body, other shapes, dimensions, and/or materials can be used. For example, in an embodiment, the base member (12) could be cylindrical (e.g., tubular) rather than tapered, one or more tubular members (14, 18) could be tapered rather than cylindrical, any of the members (12, 14, 18) could have a varying wall thickness along the length thereof, and/or any other characteristics of the members (12, 14, 18) could be varied to provide a configuration to the stress joint (10) capable of accommodating expected forces and/or motion.

Additionally, while the depicted stress joint (10) of FIG. 1A is oriented and/or adapted for securing to a wellhead structure at a first end (the lower end of the base member (12)), and to a riser at a second end (via the top flange (22)), in other embodiments, the stress joint (10) could be inverted to function as a keel joint, or otherwise configured for connection to an intermediate portion of a subsea riser or conduit, e.g., at a point of curvature therealong where forces applied thereto could otherwise damage the conduit.

Figure 1B:
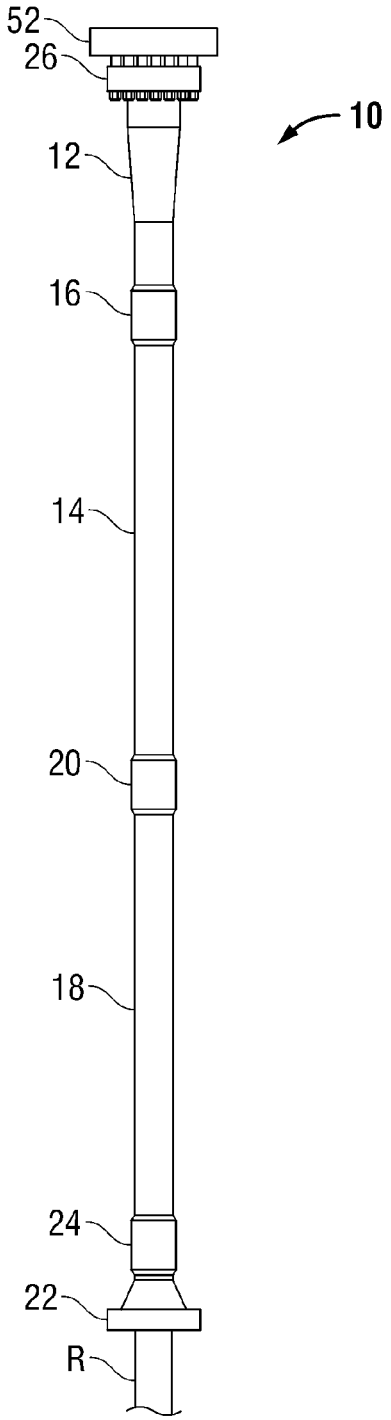
FIG. 1B depicts a diagrammatic side view of an alternate configuration of the modular stress joint of FIG. 1A usable as a keel joint.

For example, FIG. 1B depicts a diagrammatic side view of a stress joint (10) having a configuration identical to or substantially similar to that of the stress joint shown in FIG. 1A; however, the stress joint (10) shown in FIG. 1B includes a base member and base flange oriented in an upward direction, e.g., for engagement with a surface vessel and/or a conduit extending toward the surface, while the lower end of the depicted stress joint (10) is shown engaged to a subsea riser (R). As such, the depicted stress joint (10) is usable as a keel joint to provide flexibility to the upper end of the riser (R).

Figure 1C:
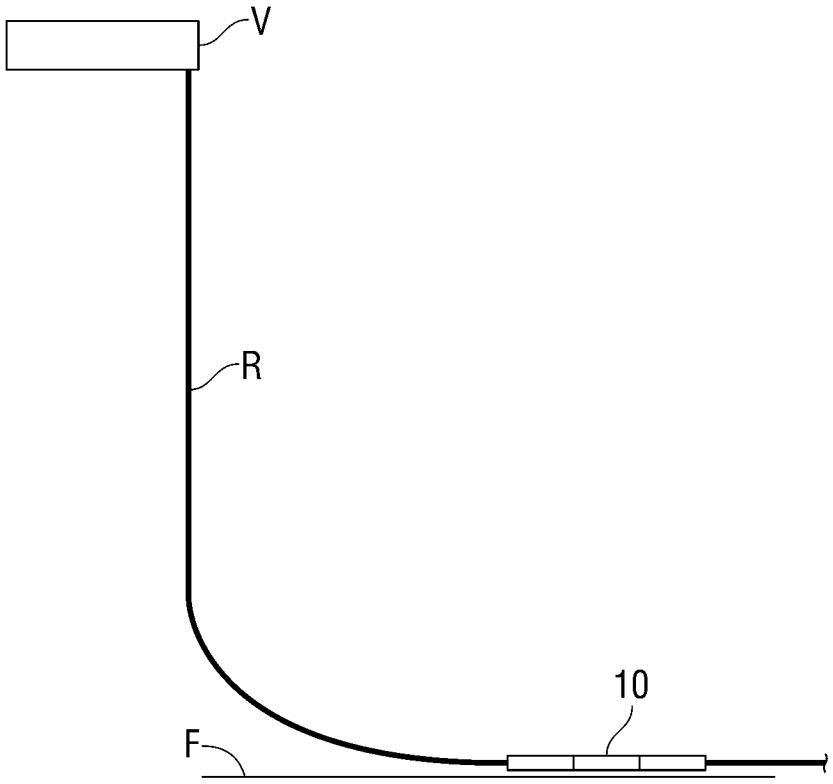
FIG. 1C depicts a diagrammatic side view of an alternate configuration of the modular stress joint of FIG. 1A usable as a catenary joint at a touchdown point proximate to the ocean floor.

FIG. 1C depicts a diagrammatic side view of a riser (R) and/or other subsea conduit extending between a surface vessel (V) and the ocean floor (F), in which the depicted modular stress joint (10) is used as a catenary joint proximate to the touchdown point, where the riser (R) nears and/or contacts the ocean floor (F), to compensate for forces and/or movement experienced by the riser (R) at that point, e.g., due to heave movements, contact with the ocean floor (F), subsea forces, etc.

Figure 1D:
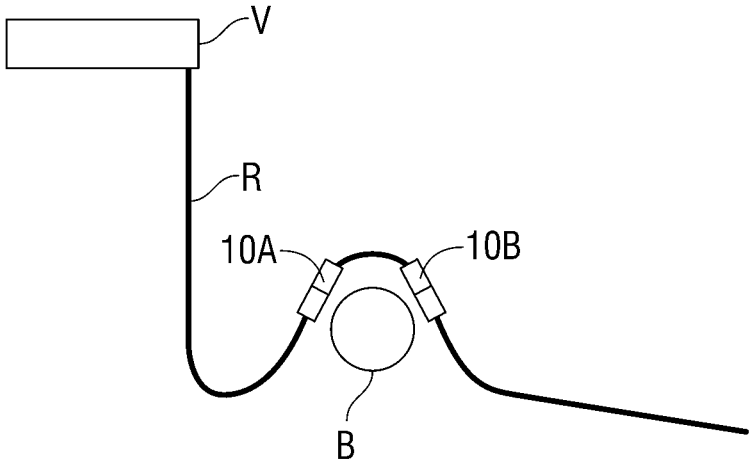
FIG. 1D depicts a diagrammatic side view of an alternate configuration of the modular stress joint of FIG. 1A usable to support a curved section of a subsea conduit above a buoy.

FIG. 1D depicts a diagrammatic side view of a riser (R) extending from a surface vessel (V), the riser (R) having a curved portion supported by a buoy (B). In this depicted configuration, two stress joints (10A, 10B) are engaged with the riser (R). Specifically, a first stress joint (10A) is shown engaged at a curved portion of the riser (R) above a first side of the buoy (B), while a second stress joint (10B) is shown engaged at a curved portion of the riser (R) above a second side of the buoy.

It should be noted that the embodiments depicted and described in FIG. 1A through 1D and below are exemplary configurations, and that embodiments of the modular stress joint described herein can be engaged with any type of subsea conduit, at any point therealong, where it would be desired to compensate for any type of forces and/or motion, without departing from the scope of the present disclosure.

Figure 2:
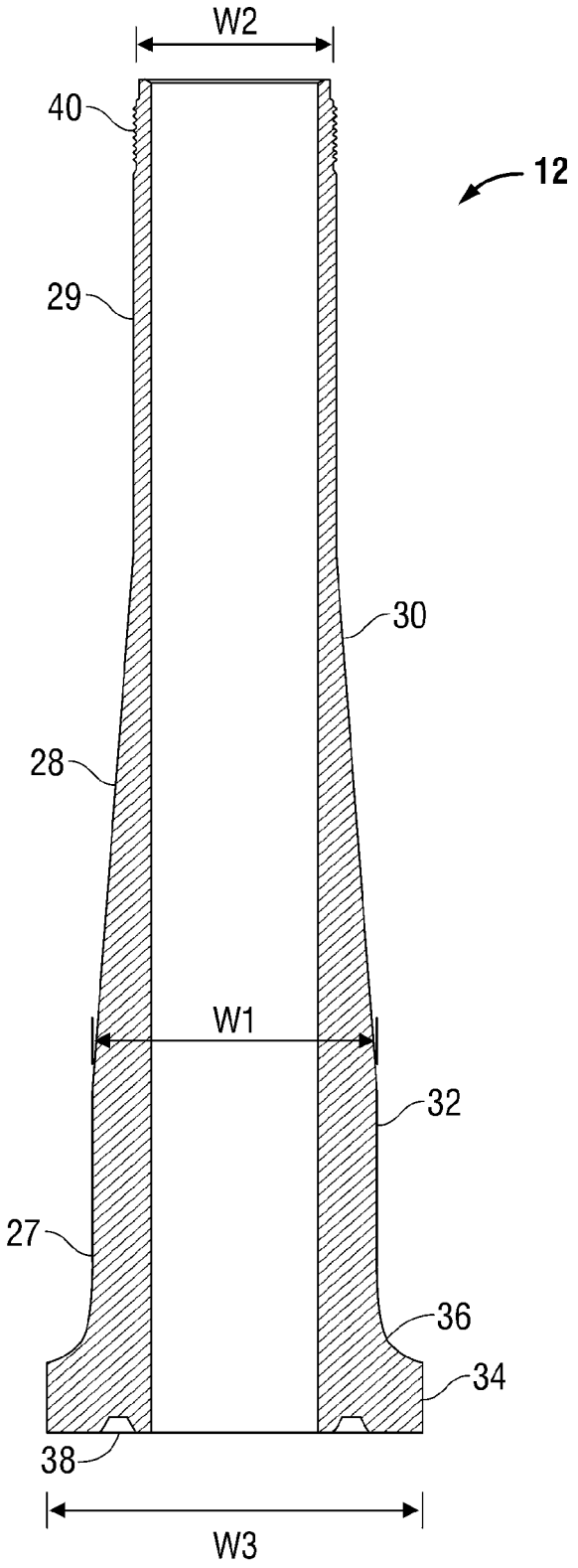
FIG. 2 depicts a side, cross-sectional view of an embodiment of a base member usable with the modular stress joint of FIG. 1A.

Referring now to FIG. 2, a side, cross-sectional view of the base member (12) of FIG. 1A is shown. While the shape, dimensions, and/or materials of the base member (12) can vary, as described above, in the depicted embodiment, the base member (12) includes a tapered body (28), defining a slope between an upper region (29) and a lower region (27) of the base member (12). The taper of the tapered body (28) further provides the base member (12) with a first taper angle and/or radius of curvature (30) between the tapered body (28) and the upper region (29), and a second taper angle and/or radius of curvature (32) between the tapered body (28) and the lower region (27). For example, the lower region (27) is shown having a first width (W1), while the upper region (29) is shown having a second width (W2) less than the first width (W1). As described previously, the taper angles and/or radii of curvature (30, 32) can be selected to provide the base member (12) with a desired distribution of forces along the length thereof and/or to permit a desired degree of flex and/or bending to accommodate for movement of a riser attached thereto. The base member (12) is further shown having a lower portion (34) at the base thereof, which is depicted as a generally cylindrical portion having a third width (W3) (e.g., diameter) greater than the widths (W1, W2) of the remainder of the base member (12). The lower portion (34) is depicted having a gasket groove (38) in a lower surface thereof for accommodating a sealing member (e.g., a gasket) to provide a fluid-tight engagement when engaged (e.g., bolted via the swivel flange (26), shown in FIG. 1A) with a wellhead and/or associated structure below. A third radius of curvature (36) is defined between the lower region (29) of the base member (12) and the lower portion (34). The third radius of curvature (36), as well as the inner diameters, outer diameters (e.g., the widths (W1, W2, W3)), taper angles/radii (30, 32), and any other dimensions, materials, and/or shapes of the base member (12) can be designed to accommodate a selected distribution of forces along the base member (12) and/or other portions of the stress joint, and/or a selected quantity of bending and/or movement of the base member (12), corresponding to expected forces and/or movement of a riser attached thereto. For example, the depicted embodiment of the base member (12) could be formed from titanium and have a length, inner diameter, first width (W1), second width (W2), and third width (W3) selected to account for such forces and/or movement based on the material of the base member (12) and/or other portions of the stress joint. FIG. 2 further depicts exterior threads (40) formed at the upper end of the base member (12) for engagement with a connector (e.g., the first connector (16), shown in FIG. 1A, which can include corresponding interior threads and/or metal-to-metal seals).

It should be understood that while FIG. 2 depicts a base member (12) having a tapered body (18) with generally cylindrical regions (27, 29) on either end thereof, and a wider lower portion (34), embodiments of base members (12) usable within the scope of the present disclosure can include any shape and/or dimensions (e.g., including a generally cylindrical/tubular member), as needed, having characteristics (e.g., length and/or wall thickness) to compensate for expected forces applied to a riser attached thereto.

Figure 3A:
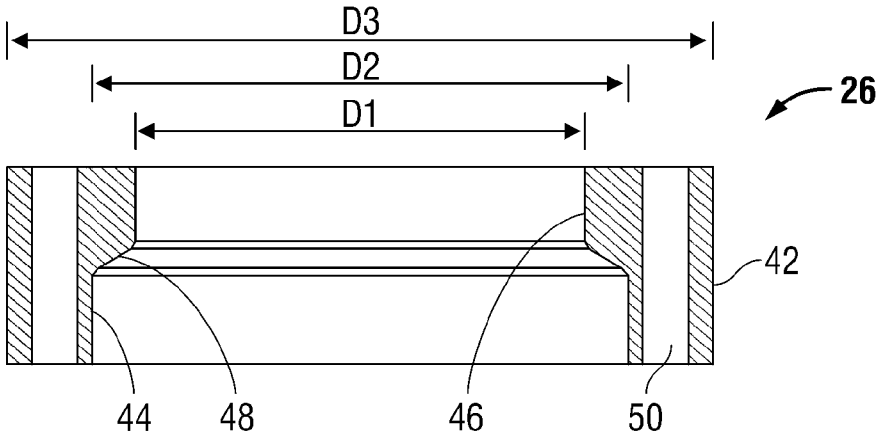
FIG. 3A depicts a side, cross-sectional view of an embodiment of a swivel flange usable with the modular stress joint of FIG. 1A.
Figure 3B:
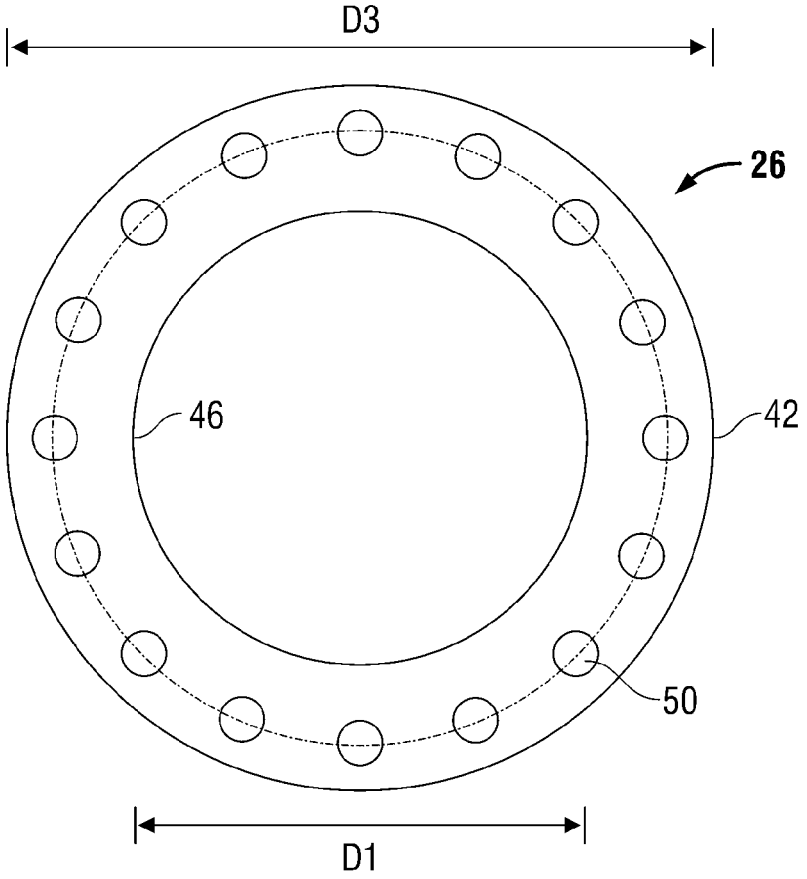
FIG. 3B depicts a diagrammatic top view of the swivel flange of FIG. 3A.

Referring now to FIGS. 3A and 3B, the swivel flange (26) of FIG. 1A is shown. Specifically, FIG. 3A depicts a side, cross-sectional view of the swivel flange (26), while FIG. 3B depicts a diagrammatic top view thereof. As shown in FIG. 1A, the swivel flange (26) can be engaged with the base member to secure the base member to a subsea well and/or associated structure. For example, FIG. 1A depicts the swivel flange engaged through the lower portion (34, shown in FIG. 2) thereof, such that the swivel flange (26) will compress the base member (12) against a lower surface, forming a sealing relationship therewith (e.g., facilitated by a gasket or similar sealing member in groove (38), shown in FIG. 2).

The swivel flange (26) is shown having a generally cylindrical outer surface (42), providing the swivel flange with an exterior diameter (D3), a first interior region (44) having interior diameter (D2), a second interior region (46) having interior diameter (D1), and a tapered region (48) extending between the interior regions (44, 46). The body of the swivel flange includes a plurality of through bores (50), extending between the outer surface (42) and the first interior region (44), each through bore (50) configured to accommodate a bolt or similar connector usable to secure the swivel flange (26) to the base member. As shown in FIG. 1A, the depicted swivel flange (26) can be used in conjunction with a base flange (52) to connect the base member of the stress joint to a lower structure and/or surface.

While FIGS. 1, 3A, and 3B depict an exemplary embodiment of a swivel flange (26), it should be understood that any manner of flange and/or connector can be used to secure the present stress joint to an adjacent object without departing from the scope of the present disclosure, or alternatively, use of a swivel flange or similar connector can be omitted and the stress joint could be attached directly to an adjacent structure.

Figure 4A:
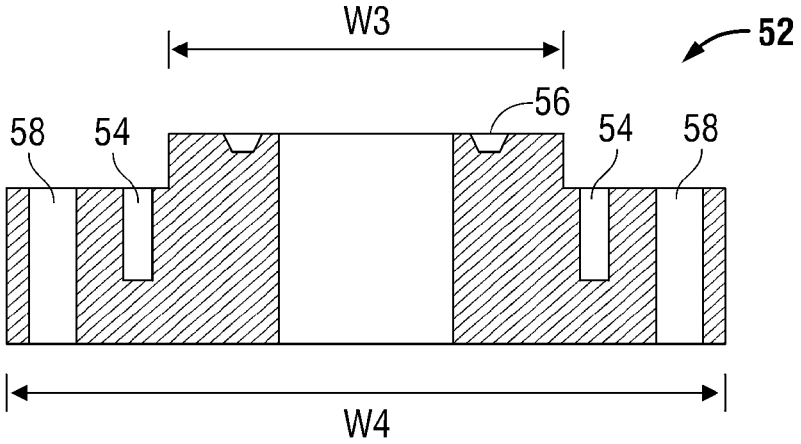
FIG. 4A depicts a side, cross-sectional view of an embodiment of a base flange usable with the swivel flange of FIGS. 3A and 3B.
Figure 4B:
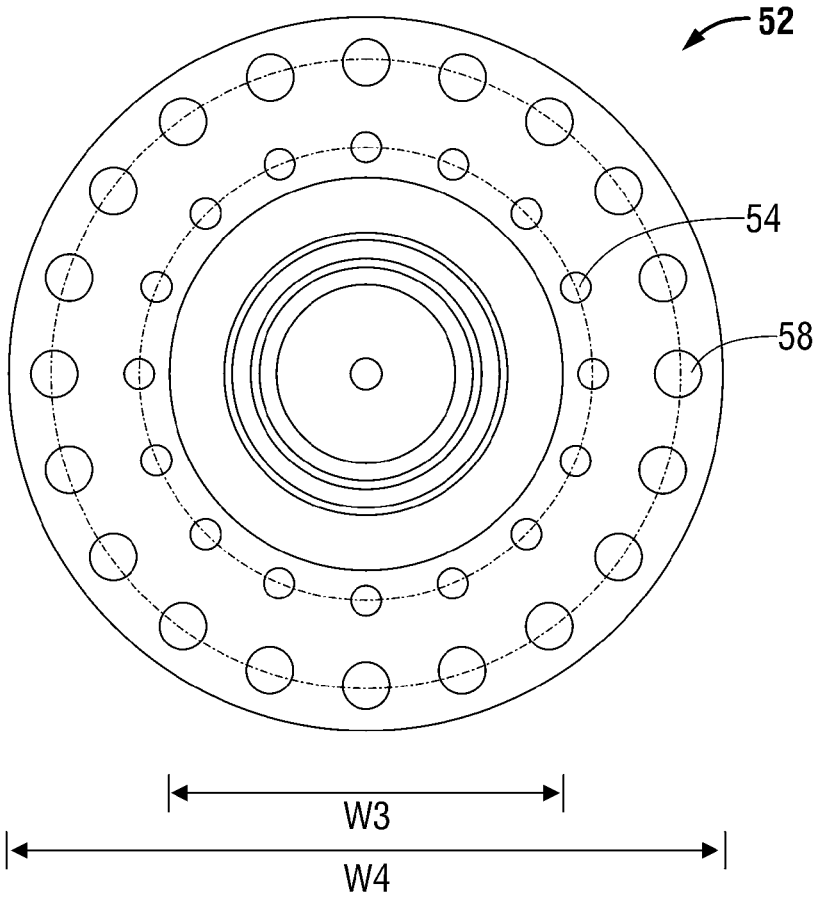
FIG. 4B depicts a diagrammatic top view of the base flange of FIG. 4A.

Referring now to FIGS. 4A and 4B, the base flange (52) of FIG. 1A is shown. Specifically, FIG. 4A depicts a side, cross-sectional view of the base flange (52), while FIG. 4B depicts a diagrammatic top view thereof. The base flange (52) is shown having a generally cylindrical body with a central through bore having the same diameter as the interior diameter of the base member, and a series of receiving bores (54) formed circumferentially around the flange, the receiving bores (54) being adapted for receiving studs and/or other elongate members extending through the aligned through bores (50, shown in FIG. 3A) of the swivel flange. The lower portion of the base member (12, shown in FIG. 1A) can be placed above (e.g., abutting) the upper surface of the base flange (52), such that the gasket groove (38, shown in FIG. 2) of the base member aligns with a gasket groove (56) in the base flange (52), thereby forming a contiguous space for accommodating one or more gaskets and/or other similar sealing members. While the dimensions of the base flange (52) can vary, FIG. 4A depicts a side cross-sectional view of the base flange (52) having a width (W3) generally equal to that of the lower portion of the base member, while the lower portion of the base flange (52) is shown having a width (W4) slightly wider than that of the swivel flange (26, shown in FIG. 3A). As such, a plurality of through bores (58) can be used to accommodate bolts and/or similar connecting members to secure the base flange (52) to a lower structure and/or surface, the connectors being positioned exterior to the swivel flange when aligned with and engaged to the base flange (52). For example, the depicted embodiment of the base flange (52) could have a width (W4) selected to correspond to the diameter (D3, shown in FIG. 3A) of the swivel flange, and the lowest portion of the base member and upper portion of the base flange (52) could have corresponding widths (W3). It should be understood, however, that the dimensions, shape, and/or materials of any of the components referenced above could be varied, depending on the expected forces, weight, length, composition, and/or other characteristics of the riser attached thereto and/or the ambient subsea environment.

Figure 5A:
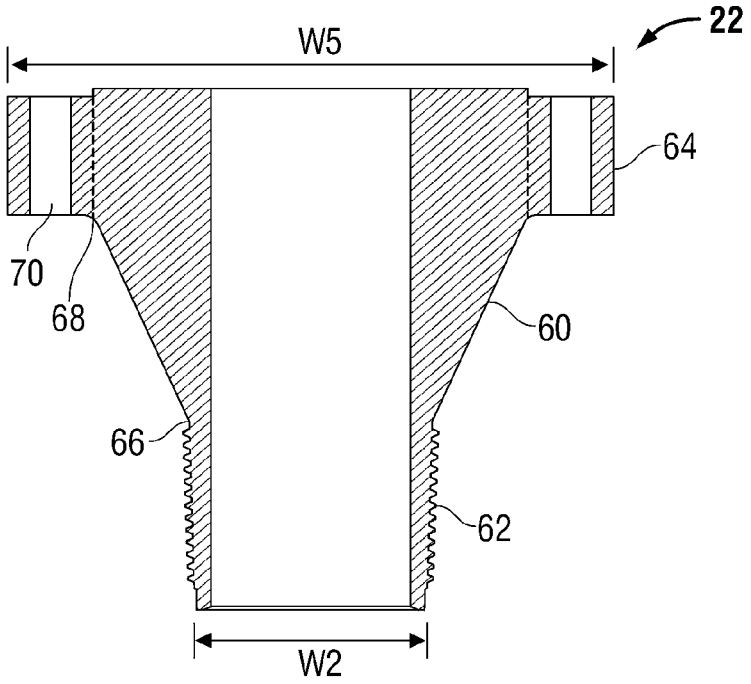
FIG. 5A depicts a side, cross-sectional view of an embodiment of a top flange, usable with the modular stress joint of FIG. 1A.
Figure 5B:
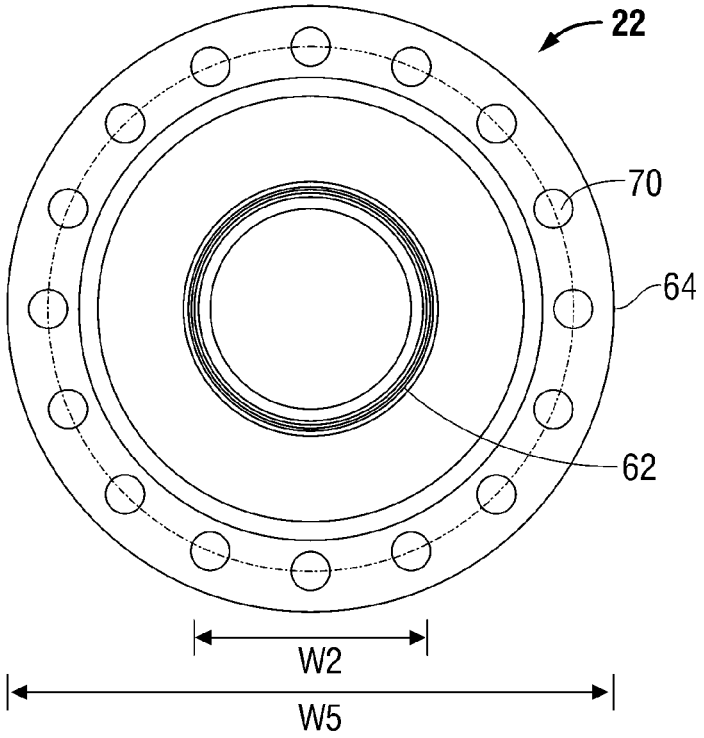
FIG. 5B depicts a diagrammatic top view of the top flange of FIG. 5A.

Referring now to FIGS. 5A and 5B, the top flange (22) of FIG. 1A is shown. Specifically, FIG. 5A depicts a side, cross-sectional view of the top flange (22), while FIG. 5B depicts a diagrammatic top view thereof. The depicted top flange (22) includes a tapered body (60), a lower section having exterior threads (62) thereon, and a generally cylindrical upper section (64). The taper of the body (60) defines a first radius of curvature (66) between the lower section and the tapered body (60), and a second radius of curvature (68) between the tapered body (60) and the upper section (64). The taper and the radii of curvature (66, 68) can be selected to provide the top flange (22) with a favorable distribution of forces as the stress joint bends, moves and/or otherwise accommodates movement of and/or forces applied to a riser attached therewith. Additionally, the taper of the body (60) can be selected such that the top flange (22) tapers from a width (W2) generally equal to that of the upper portion of the base flange (12, shown in FIGS. 1 and 2) and that of the tubular members (14, 16, shown in FIG. 1A), to a width (W5) suitable for engagement with a portion of a riser, a riser flange, and/or another suitable surface and/or structure above the top flange (22). For example, the top flange (22) could taper from a narrow width (W2) corresponding to the diameter of the tubular member below, to a larger width (W5), corresponding to the dimensions of the riser and/or other member secured above; however, it should be understood that the dimensions, shape, and/or materials of the top flange (22) and other portions of the stress joint can be varied, as described previously, without departing from the scope of the present disclosure. Furthermore, while the top flange (22) is shown having male threads thereon for connection to a coupling connector, as shown in FIG. 1A, the top flange can also be configured with an integrated threaded female connection so that it can be directly connected to an upper tubular member without use of a coupling connector. A plurality of through bores (70) is shown for accommodating bolts and/or other similar connectors usable to secure the top flange (22) to an adjacent object.

Figure 6:
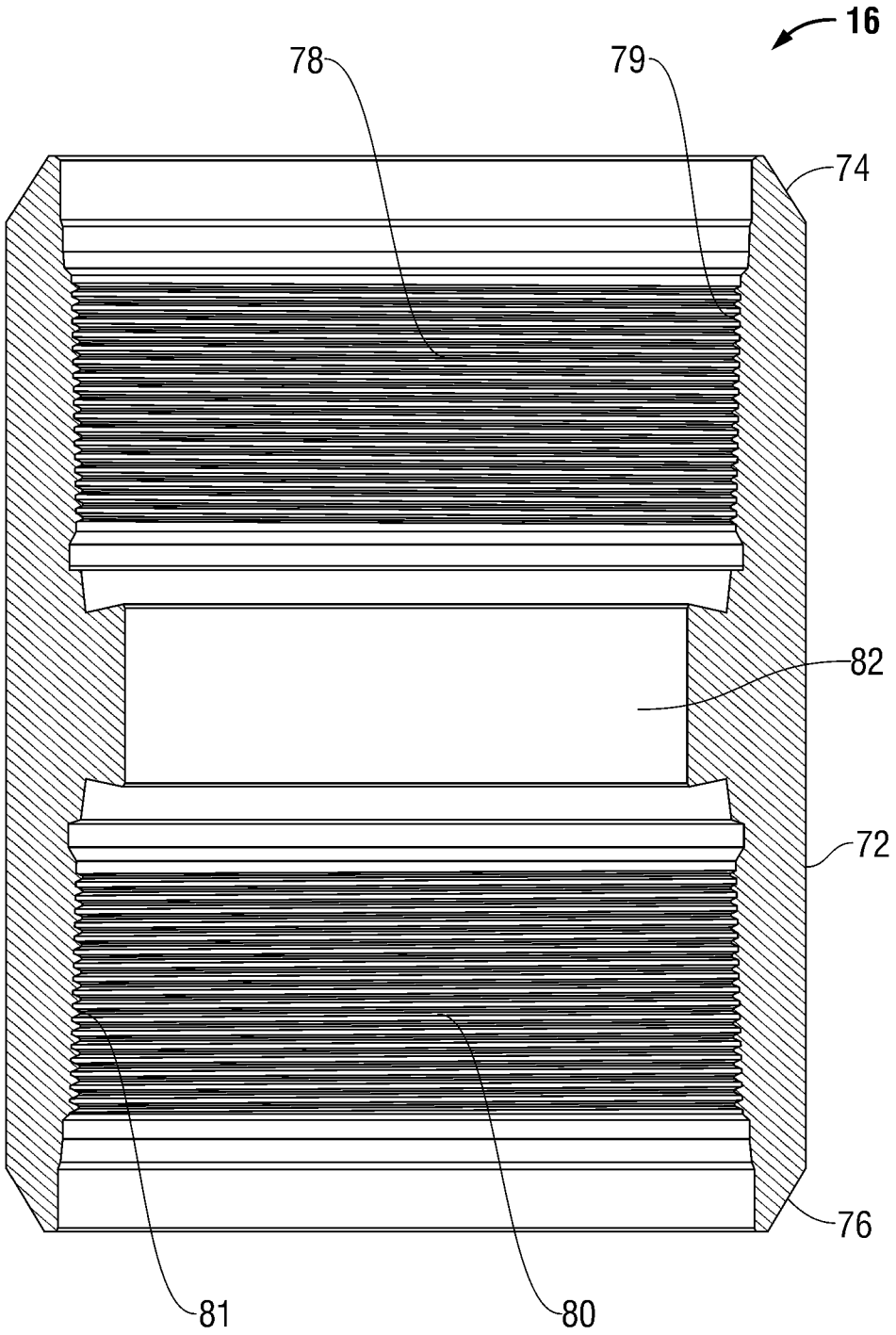
FIG. 6 depicts a side, cross-sectional view of an embodiment of a connector usable with the modular stress joint of FIG. 1A.

Referring now to FIG. 6, a side, cross-sectional view of the connector (16) of FIG. 1A is shown. While FIG. 6 depicts a single connector (16), it should be understood that embodied stress joints usable within the scope of the present disclosure can include any number of connectors (e.g., connectors (16, 20, 24), shown in FIG. 1A), and the connectors used can include identical, similar, or different types of connectors without departing from the scope of the present disclosure.

The depicted connector (16) is shown having a generally cylindrical body (72) with a first beveled end (74) and a second beveled end (76). While the beveled ends (74, 76) are shown having a beveled surface angled approximately 30 degrees relative to the sidewall of the connector (16), in various embodiments, the beveled ends (74, 76) could have any angle, as desired to provide structural and/or material characteristics to the connector (16), or alternatively, use of beveled regions could be omitted. The interior of the connector (16) includes a generally cylindrical bore (82) having a first cavity (78) at a first end, with interior threads (79) formed therein, and a second cavity (80) at a second end, with interior threads (81) formed therein. As described previously and shown in FIG. 1A, exterior threads of the base member, one or more tubular members, and/or the upper flange can engage the interior threads of one or more connectors. Additionally, while FIG. 6 depicts a threaded connector, it should be understood that other methods of connection, such as clamps, could also be used without departing from the scope of the present disclosure.

As such, embodiments of the modular stress joint (10), such as those depicted and described herein, can include multiple parts (e.g., a base member (12), tubular members (14, 18), top flange (22), swivel flange (26), base flange (52), connectors (16, 20, 24), and any bolts, studs, and/or other materials usable to assemble the stress joint), each part sized to enable convenient transport and on-site assembly thereof. The overall length of the stress joint (10) can be adjusted and/or controlled through selection of a given number and/or length of tubular members (14, 18), such that the stress joint (10) can be provided with any desired overall length suitable to compensate for expected forces and/or motion of a conduit and/or other structure with which it is engaged (e.g., through selection of a combination of structural members having respective lengths that, when combined, provide the desired overall length). Additionally, or alternatively, the overall stiffness of the stress joint (10) at any point along the length thereof can be modified by selecting members having desired wall thicknesses and/or other material characteristics. This modular configuration, through which the length, stiffness, or combinations thereof, of the stress joint (10) can be adjusted through selection and assembly of structural members that provide a desired length and a desired stiffness, enables the modular stress joint to be adapted for use with any riser, well, and/or subsea environment or structure, then disassembled and transported for reuse with another riser, well, and/or subsea environment or structure. Further, embodiments of the modular stress joint (10) can include combinations of high modulus and low modulus materials, such that the overall size of the stress joint (10) can be adjusted when materials with differing moduli of elasticity are used. For example, the base member (12) and tubular members (14, 18) can be formed from titanium, while the connectors (16, 20, 24) can be formed from steel; however, other combinations of low and high modulus of elasticity materials can also be used without departing from the scope of the present disclosure.

Embodiments usable within the scope of the present disclosure thereby provide modular stress joints and related methods able to compensate for forces and/or movement experienced by any riser in any subsea environment, through use of a multi-part, modular system and/or a combination of low and high modulus materials.

While various embodiments usable within the scope of the present disclosure have been described with emphasis, it should be understood that within the scope of the appended claims, the present invention can be practiced other than as specifically described herein.

What is claimed is:

1. A modular stress joint for connection between a subsea structure and a compatible engagement structure for compensating for forces applied to the subsea structure, the modular stress joint comprising:

a base member secured to the subsea structure by means of a swivel flange compressing the base member therethrough, the base member having a first end and a second end, wherein the base member comprises a first length, and a first wall thickness; and a plurality of additional members secured to the second end of the base member, wherein the plurality of additional members comprises additional lengths and additional wall thicknesses, wherein at least one of the plurality of additional members comprises a different length, diameter, shape, wall thickness, material, or combinations thereof, from other additional members of the plurality of additional members, wherein a sum of the first length and the additional lengths defines a total length, wherein a combination of the first wall thickness and the additional wall thicknesses defines an overall wall thickness, and wherein the total length and the overall wall thickness correspond to forces applied to the subsea structure secured to said base member, said at least one additional member, or combinations thereof.

2. The modular stress joint of claim 1, wherein the base member comprises a tapered body, wherein the first end comprises a first width, and wherein the second end comprises a second width less than the first width.

3. The modular stress joint of claim 2, wherein the base member further comprises a lower portion at the first end having a third width greater than the first width, and wherein the base member further comprises a curvature between the lower portion and the first end adapted to compensate for the expected forces and prevent damage to the subsea structure.

4. The modular stress joint of claim 1, wherein the base member further comprises at least one curvature between the first end and the second end, and wherein the curvature comprises a radius adapted to compensate for the expected forces and prevent damage to the subsea structure.

5. The modular stress joint of claim 1, further comprising at least one connector secured between the base member and said plurality of additional members.

6. The modular stress joint of claim 1, wherein the base member, said plurality of additional members, or combinations thereof comprise a first material having a first modulus of elasticity, and wherein said at least one connector comprises a second material having a second modulus of elasticity greater than the first modulus of elasticity.

7. The modular stress joint of claim 1, wherein the base member, said plurality of additional members, or combinations thereof comprise exterior threads formed thereon, and wherein said at least one connector comprises interior threads formed therein, complementary to and adapted to receive the exterior threads.

8. The modular stress joint of claim 1, further comprising a top flange comprising a tapered body having a lower section and an upper section, wherein the upper section comprises a width corresponding to a dimension of the compatible engagement structure, wherein the lower section comprises a width corresponding to the diameter of the plurality of additional members, and wherein the top flange is attached to the plurality of additional members via a plurality of through bores accommodating a plurality of connecting members.

9. A modular stress joint for compensating for forces applied to a subsea structure, the modular stress joint comprising:

a first member having a first end and a second end, wherein the first member comprises a first material having a first modulus of elasticity, wherein the first end of the first member is secured to the subsea structure by means of a swivel flange compressing the first member therethrough;

a second member having a first end and a second end, wherein the second member comprises the first material having the first modulus of elasticity;

a connector secured to the second end of the first member and the first end of the second member, thereby connecting the first member to the second member, wherein the connector comprises a second material having a second modulus of elasticity greater than the first modulus of elasticity; and at least one additional member connected to the second end of the second member, wherein the at least one additional member comprises an additional length, additional wall thickness, diameter, shape, material, or combinations thereof, different from the second member.

10. The modular stress joint of claim 9, wherein the first member, the second member, or combinations thereof comprise exterior threads formed thereon, and wherein the connector comprises interior threads formed therein, complementary to and adapted to receive the exterior threads.

11. The modular stress joint of claim 9, wherein the first member further comprises a tapered body between the first end and the second end, wherein the first end comprises a first width, and wherein the second end comprises a second width less than the first width.

12. The modular stress joint of claim 11, wherein the first member further comprises a lower portion at the first end having a third width greater than the first width, and wherein the first member further comprises a curvature between the lower portion and the second end adapted to compensate for the expected forces and prevent damage to the subsea structure.

13. The modular stress joint of claim 11, wherein the first member further comprises at least one curvature between the first end and the second end, and wherein the curvature comprises an elliptical shape adapted to compensate for the expected forces and prevent damage to the subsea structure.

14. The modular stress joint of claim 9, wherein the first member comprises a first length and a first wall thickness, wherein the second member comprises a second length and a second wall thickness, wherein each of the at least one additional members comprises said additional lengths and said additional wall thicknesses, wherein a sum of the first length, the second length, and the additional lengths defines a total length, wherein a combination of the first wall thickness, the second wall thickness, and the additional wall thicknesses defines an overall wall thickness, and wherein the total length and the overall wall thickness correspond to forces applied to the subsea structure secured to the second member.

15. The modular stress joint of claim 9, further comprising a top flange comprising a tapered body having a lower section and an upper section, wherein the upper section comprises a width corresponding to a dimension of a compatible engagement structure, wherein the lower section comprises a width corresponding to the diameter of the at least one additional member, and wherein the top flange is attached to the at least one additional member via a plurality of through bores accommodating a plurality of connecting members.

16. A method for compensating for forces applied to a subsea structure, the method comprising the steps of:

engaging a base member between a first structure and a second structure by means of a swivel flange compressing the base member therethrough, wherein the base member comprises a first length and a first wall thickness;

engaging a plurality of additional members with the base member, wherein said plurality of additional members comprise additional lengths and additional wall thicknesses, wherein at least one of the plurality of additional members comprises a different additional length, additional wall thickness, diameter, shape, material, or combinations thereof, from other additional members of the plurality of additional members, wherein a sum of the first length and the additional lengths are selected to define a total length, wherein a combination of the first wall thickness and the additional wall thicknesses are selected to define an overall wall thickness, and wherein the total length and the overall wall thickness correspond to forces applied to the first structure, the second structure, or combinations thereof; and engaging the second structure to the plurality of additional members.

17. The method of claim 16, wherein the step of engaging said plurality of additional members to the base member comprises engaging a connector to an end of the base member and engaging an end of the plurality of additional members to the connector, wherein the base member and the plurality of additional members comprise a first material having a first modulus of elasticity, and wherein the connector comprises a second material having a second modulus of elasticity greater than the first modulus of elasticity.

18. The method of claim 17, wherein the step of engaging the connector to the end of the base member and the step of engaging the end of the plurality of additional members to the connector comprise engaging exterior threads of the end of the base member and the end of the plurality of additional members with complementary interior threads of the connector.

19. The method of claim 16, wherein the first structure comprises a subsea wellhead or a surface vessel, and wherein the second structure comprises a subsea conduit.

20. The method of claim 16, wherein the first structure comprises a first portion of a subsea conduit, and wherein the second structure comprises a second portion of the subsea conduit.

* * * * *